US005337070A

United States Patent [19]

Kitajima et al.

[11] Patent Number: 5,337,070

[45] Date of Patent: Aug. 9, 1994

[54] DISPLAY AND THE METHOD OF DRIVING THE SAME

[75] Inventors: Masaaki Kitajima, Hitachiota; Ikuo Hiyama; Yoshiharu Nagae, both of Hitachi, all of Japan

[73] Assignee: Hitachi, Ltd., Tokyo, Japan

[21] Appl. No.: 922,397

[22] Filed: Jul. 31, 1992

[30] Foreign Application Priority Data

Jul. 31, 1991 [JP] Japan ..... 3-191500

[51] Int. Cl.[5] ..... G09G 3/00

[52] U.S. Cl. ..... 345/211; 345/98

[58] Field of Search ..... 340/784, 781, 805, 793; 345/76, 94, 95, 98, 87, 88, 89, 100, 208, 210

[56] References Cited

U.S. PATENT DOCUMENTS

| | | | |
|---|---|---|---|
| 4,736,137 | 4/1988 | Ohwada et al. | 340/781 |
| 4,870,398 | 9/1989 | Bos | 340/805 |
| 5,021,774 | 6/1991 | Ohwada et al. | 340/784 |
| 5,091,722 | 2/1992 | Kitajima et al. | 340/784 |
| 5,151,689 | 9/1992 | Kabuto et al. | 340/784 |
| 5,157,386 | 10/1992 | Uchida et al. | 340/784 |

FOREIGN PATENT DOCUMENTS 2-264294 10/1990 Japan .

*Primary Examiner*—Alvin E. Oberley
*Assistant Examiner*—Gin Goon
*Attorney, Agent, or Firm*—Antonelli, Terry, Stout & Kraus

[57] ABSTRACT

A method of driving a gray scale and a drive circuit therefor are provided in which the simplification and reduction of the operating speed of a circuit for generating display voltages in a matrix display device are promoted, and low cost and multi-color display of high minuteness are simultaneously realized. The display circuit for generating the display voltages is composed of an image signal processing circuit for dividing an input digital image signal into plural bit groups, a first display voltage generating circuit for generating the display voltages corresponding to the first bit group obtained by the division, a second display voltage generating circuit for generating the display voltages corresponding to the second bit group obtained by the division, and a line-at-a-time timing circuit. The first and second display voltage generating circuits are operated in parallel to combine the outputs thereof with one another, thereby to generate a gray scale displaying voltage.

30 Claims, 13 Drawing Sheets

DATA IS IN CASE OF 1 DOT UNIT

DISPLAY AND THE METHOD OF DRIVING THE SAME

BACKGROUND OF THE INVENTION

The present invention relates to a drive circuit of an image display and a method of driving the same, and more particularly to a display, such as a liquid crystal display, a plasma display, and an EL display, which is suitable for displaying a gray scale of high picture quality with a simple circuit, and a method of driving the same.

As for a technology of displaying a gray scale in the prior art display, there is given JP-A-2-264294. A circuit portion and a performance chart which are directly related to the present invention are shown in FIG. 16A and FIG. 16B, respectively. In those figures, a reference numeral 100 designates an analog gate, a reference numeral 101 designates a holding capacitor, a reference numeral 102 designates an output buffer circuit, and a reference numeral 103 designates a level shifter.

As shown in this well known example, a step-like voltage As for determining brightness of a liquid crystal panel has voltage levels corresponding to only the number of gradations in brightness for being displayed on a display panel, e.g., 16 gradations.

That voltage is latched through the analog gate 100 in accordance with a timing signal Rpw(i). In this case, the gate 100 holds the voltage As at the rise of the timing signal Rpw(i). Since the pulse width of the above timing signal Rpw(i) is changed depending on the gradation information, the voltage at the analog gate 100 is changed. Thus, it is possible to display the gray scale.

In the above scheme, especially when the display panel is driven, the smaller circuit is available, as compared with any other scheme. However, the number of gradations in brightness become more than or equal to 16 and the duty ratio of the drive becomes small. That is, when the number of scanning lines increases, the drive time per gradation becomes short, and thus the analog gate 100 needs to be operated at high speed. As a result, not only the power consumption of the circuit increases, but also the noise from the timing signal Rpw(i) as the output signal of the level shifter 103 is superimposed on the output of the analog gate 100. As a result, the display of the display panel becomes nonuniform, and further a fixed noise pattern is generated.

SUMMARY OF THE INVENTION

It is therefore an object of the present invention to reduce an operating speed of a display circuit for generating display voltages to reduce the variation of the display voltages between output terminals of the circuit, thereby to realize a display of high picture quality, and also to provide a display which is capable of providing miniaturization, low power consumption and high reliability of a circuit, and a method of driving the same.

In order to attain the above object, according to one aspect of the present invention, there is provided a display device wherein means for generating display voltages to be applied to display electrodes of a display panel includes means for dividing a digital image signal into plural bit groups in display dots, plural voltage selecting circuits assigned in correspondence to the divided image signals, and means for operating the voltage selecting circuits in parallel, thereby to lower an operating frequency of a circuit.

As to the description regarding the operation of the display device having such a configuration, source voltages for defining brightness of a liquid crystal panel are divided into plural bit groups, and firstly, in correspondence to a first bit group obtained by the division, some of the source voltages are selected by first display voltage generating means, and secondly, in correspondence to a second bit group obtained by the division, some of the source voltages selected by the first generating means are further selected by second display voltage generating means. Thus, by the parallel operation of the first and second display voltage generating means, it is possible to largely shorten a time which is required to select the source voltages and corresponds to the gradation of an image signal to be desired.

The substantial reduction of the selection time of the source voltages allows the size of a switch used in a selection circuit to be greatly miniaturized, whereby the noise from the control signal used for controlling the switch can be reduced, and the signal-to-noise ratio of the output signal can be improved. Further, it is possible to realize the low power consumption and the high reliability of the circuit.

DESCRIPTION OF THE PREFERRED EMBODIMENTS

The preferred embodiments of the present invention will hereinafter be described with reference to the accompanying drawings.

Figure 1:
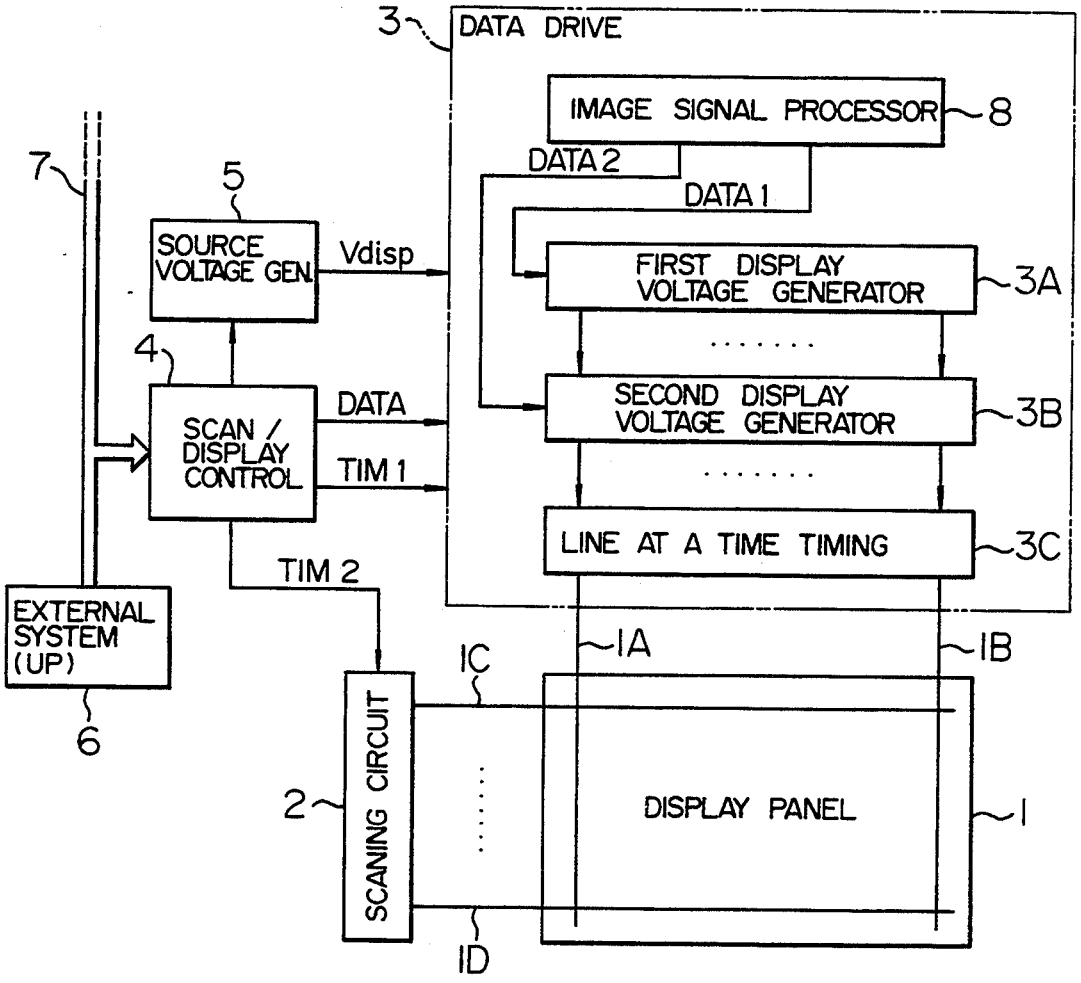
FIG. 1 is a block diagram showing a configuration of the whole display system according to the present invention.

FIG. 1 shows in a block diagram, a configuration of the whole display according to the present invention. The present display includes a display panel 1 for displaying thereon an image, a scanning circuit 2 for driving scanning electrodes 1C, 1D of the display panel 1, a display circuit 3 for driving display electrodes 1A, 1B, a control circuit 4 for controlling the scanning circuit 2 and the display circuit 3, a source voltage generating circuit 5 for generating a source voltage Vdisp, an external system 6 composed of a microprocessor and the like, and a bus signal line 7 for transmitting therethrough information to or from the external system 6. Moreover, the display circuit 3 is made up of an image signal processing circuit 8 for processing an image signal DATA inputted from the control circuit 4, first display voltage generating means 3A and second display voltage generating means 3B for generating display voltages used for driving the display panel 1 with the image signal DATA and the source voltages Vdisp, and a line-at-a-time timing circuit 3C for driving the display panel 1 in a line at a time.

Figure 2:
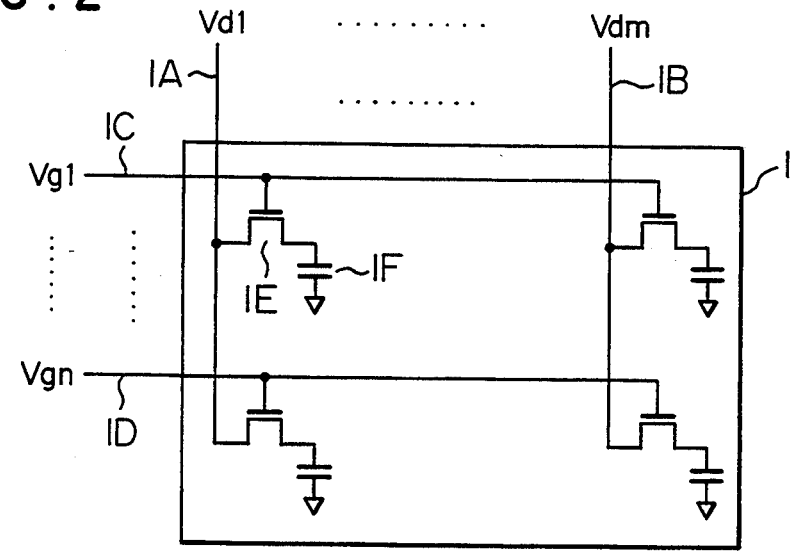
FIG. 2 is a circuit diagram showing an arrangement of one embodiment of a part of the display shown in FIG. 1.

The embodiment of the present invention shown in FIG. 1 will hereinafter be described in detail and in due order. FIG. 2 is a circuit diagram showing an arrangement of one embodiment of the display panel 1. The display panel 1 is made up of plural display electrodes 1A, 1B, plural scanning electrodes 1C, 1D, TFTs (Thin Film Transistors) 1E which are disposed at intersections between the display electrodes 1A, 1B and the scanning electrodes 1C, 1D, and a liquid crystal 1F which is connected to TFT to construct display picture elements.

Scanning voltages Vgl to Vgn are applied to the scanning electrodes 1C, 1D, thereby to drive TFTs 1E in sequence with the lines. On the other hand, display voltages Vdl to Vdm for defining the brightness of the liquid crystal are applied to the display electrodes 1A, 1B synchronously with the timing of the scanning voltages.

The construction of the display panel 1 is not limited to that of the present embodiment. For example, the display panel may be any other display body such as electroluminesence or plasma, and thus it is not especially limited. Moreover, the electrodes constituting the panel and the drive element for driving the display body are also not limited to those having such construction.

The image signal processing circuit 8 serves to latch an image signal DATA from the control circuit 4 in sequence to divide it into a first image signal DATA1 and a second image signal DATA2, thereby to input the resultant signals to the first voltage generating means 3A and the second display voltage generating means 3B, respectively. Incidentally, the image signals DATA may be color signals including gradation information of the respective picture elements, and thus the form thereof is not specifically limited.

Next, the description will be given to an embodiment of a circuit made up of the first display voltage generating means 3A, the second display voltage generating means 3B, and the line-at-a-time timing circuit 3C which are the features in configuration of the present invention, on referring to FIG. 3.

The first display voltage generating means 3A is made up of a selection signal generating circuit 9, and voltage selecting circuits 10A, 10B. The first image signal DATA1 is inputted from the image signal processing circuit 8 to the selection signal generating circuit 9. Moreover, plural source voltages Vdispl to Vdispk are inputted from the source voltage circuit 5 to the voltage selecting circuits 10A, 10B. The number of voltage selecting circuits 10A, 10B is generally the same as that of the display dots corresponding to one row of the display panel, and each of the circuits 10A, 10B selects one of Vdispl to Vdispk with the corresponding one of selection signals SLl to SLm.

Incidentally, the voltage selecting circuits 10A, 10B are not specifically limited to the construction shown but can be constructed differently therefrom as long as they transmit the analog voltage in accordance with a similar operation.

On the other hand, the second display voltage generating means 3B is made up of a sampling control circuit 11, and sampling switching circuits 12A, 12B. The second image signal DATA2 is inputted from the image signal processing circuit 8 to the sampling control circuit 11 which generates sampling signals $\phi l$ to $\phi m$ by receiving that signal. Moreover, the sampling circuits 12A, 12B latch the voltages, (selected in accordance with the above sampling signals $\phi l$) provided to $\phi m$ by the voltage selecting circuits 10A, 10B and, in turn output those voltages.

Incidentally, each of the sampling switching circuits 12A, 12B may be a circuit which transmits an analog voltage, and thus the construction thereof is not especially limited. Now, as for the display voltage generating means 3B, such means is available that is disclosed in U.S. Pat. No. 5,091,722 issued Feb. 25, 1992, and assigned, in which to the present assignee the disclosure of which is incorporated herein by reference.

Finally, the line-at-a-time timing circuit 3C is made up of capacitors 13A, 13B, switching circuits 14A, 14B, capacitors 15A, 15B, and output buffer circuits 16A, 16B. Each of the switching circuits 14A, 14B may be a circuit which transmits an analog voltage, and thus the construction thereof is not especially limited.

The capacitors 13A, 13B may be included in the second display voltage generating means 3B. Thus, the arrangement positions thereof are not especially limited as long as the same effects are obtained.

Further, in the case where the switching circuits 14A, 14B are formed by MOS FETs, the gate capacitances of FETs and the wiring capacitances may be utilized as the capacitances of the capacitors 13A, 13B, and thus the form of each of the capacitors 13A, 13B is not especially limited. This is also applied to the capacitors 15A, 15B similarly.

Moreover, even if the output buffer circuits 16A, 16B are omitted, the effects of the present invention are not harmed. Further, a part of or the whole first display voltage generating means 3A, the second display voltage generating means 3B and the line-at-a-time timing circuit 3C may be formed in an internal portion of the display panel 1 integrally therewith. As a result, the miniaturization and the low cost of the system can be promoted.

Figure 3:
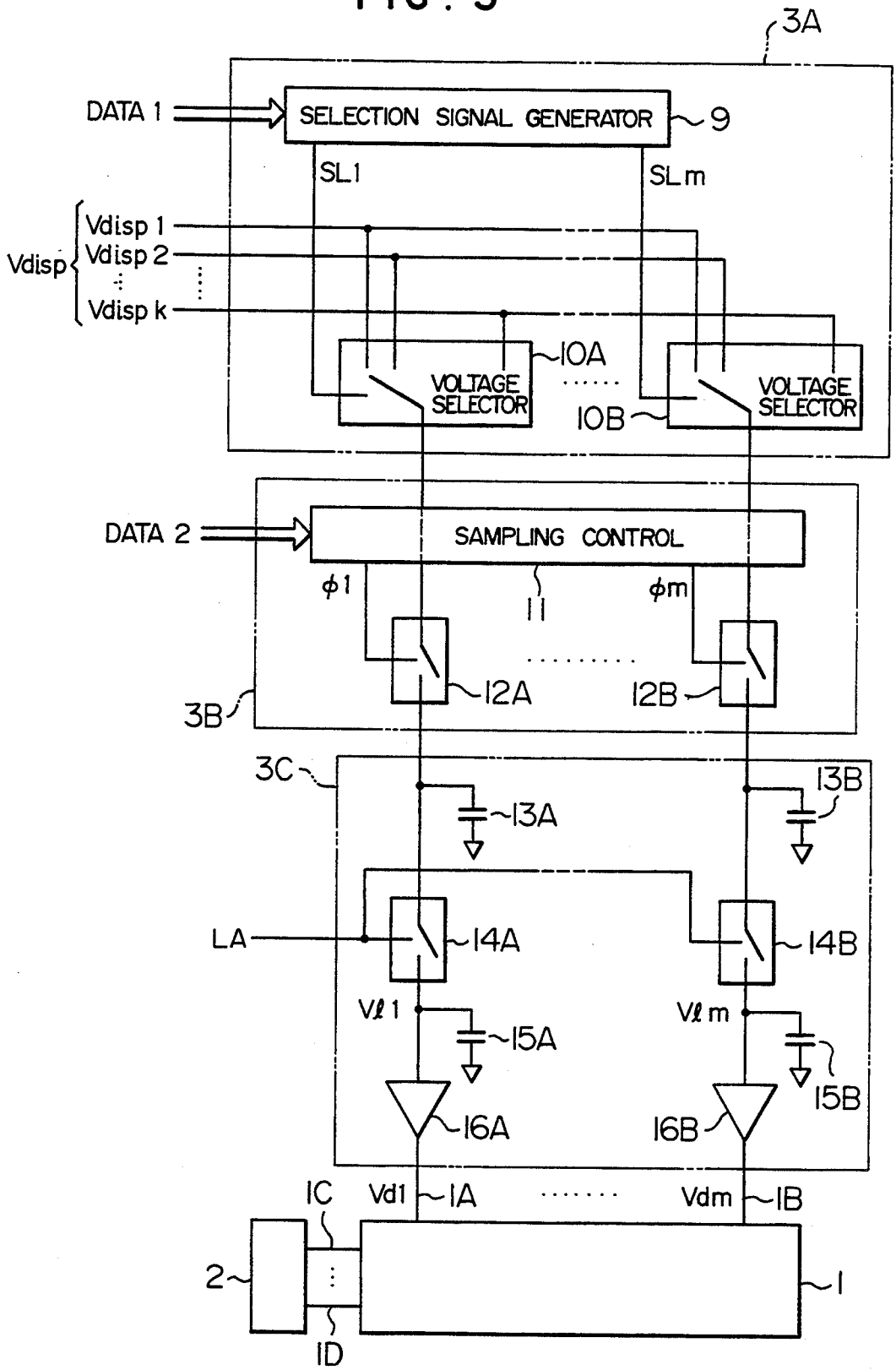
FIG. 3 is a block diagram showing a configuration of one embodiment of a display circuit according to the present invention.
Figure 4:
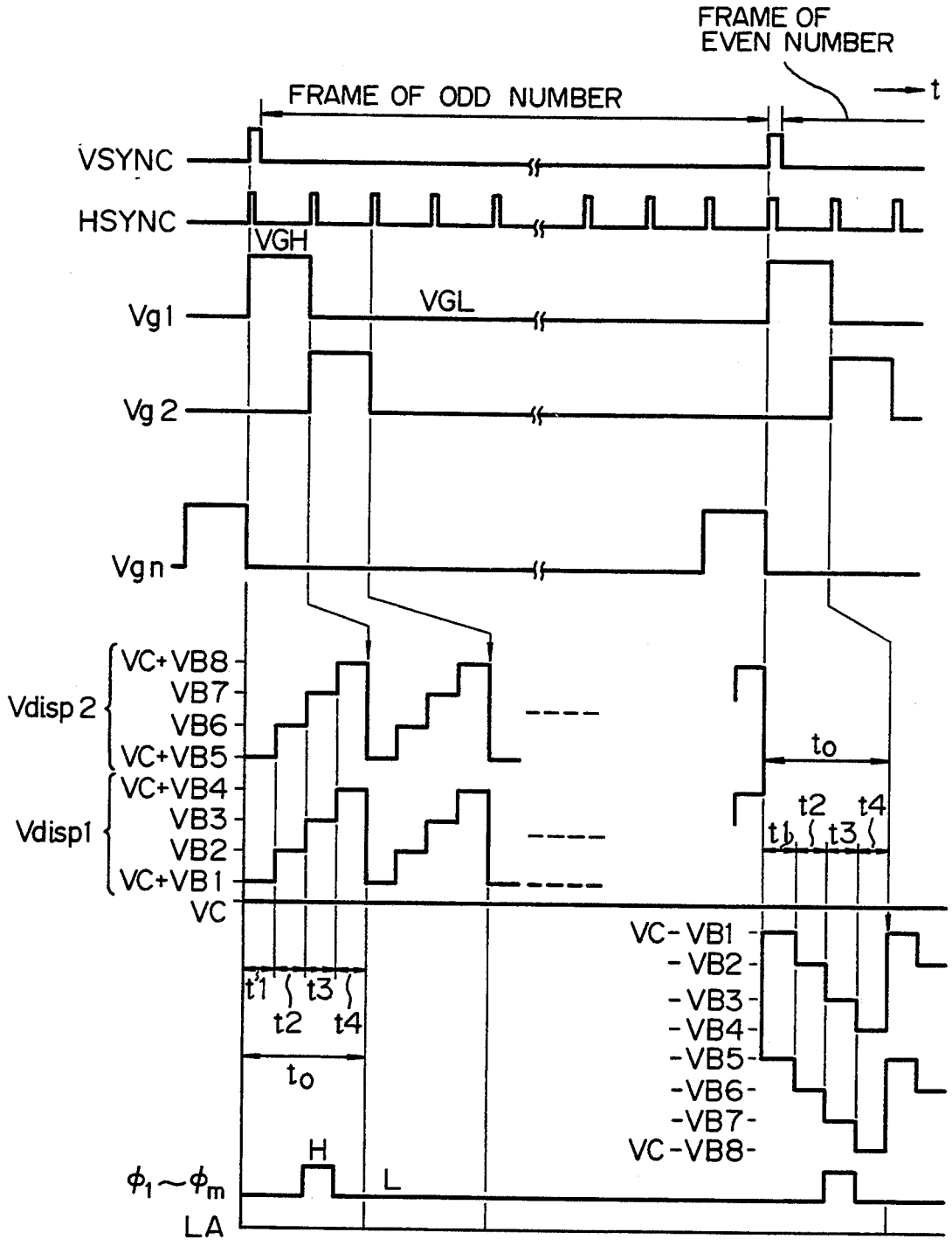
FIG. 4 is a timing chart showing an example of the operation of the display circuit shown in FIG. 3.

Next, the description will be given to the operation of each section shown in FIG. 3 with reference to FIG. 4 showing a timing chart of the signals. In the present embodiment, it is assumed that the number of gradations of an image to be displayed on the liquid crystal cell 1F is 8, and the number of source voltages Vdisp to be inputted to the voltage selecting circuits 10A, 10B of the first display voltage generating means 3A is 2.

Each of signals VSYNC, and HSYNC is a timing signal for operating the scanning circuit 2 and corresponds to TIM2 shown in FIG. 1. By those signals, the scanning circuit 2 generates scanning voltages Vgl to Vgn in sequence. When the level of the scanning voltage reaches VGH, TFT 1E is rendered conductive, while when the level thereof reaches VGL, it is rendered non-conductive. Therefore, TFT 1E is rendered conductive every horizontal line so that the display voltage is written to the liquid crystal cell.

Each of the voltage selecting circuits 10A, 10B selects one of the source voltages Vdisp1, and Vdisp2 with the corresponding output signal of the output signals SL1 to SLm from the selection signal generating circuit 9 to output it. At this time, the first image signal DATA1 is a signal of 1 bit. In this connection, Vdisp1 and Vdisp2 have voltage waveforms as stated below, respectively.

In a certain frame (e.g., a frame of even number), Vdisp1 of the source voltage has four levels consisting of VB1, VB2, VB3 and VB4 with VC as a reference. Further, Vdisp2 has four levels consisting of VB5, VB6, VB7 and VB8 with VC as a reference. Thus, as a whole, there are provided eight levels of VB1 to VB8 with VC as a reference.

Moreover, in the next frame (frame of odd number), Vdisp1 has four levels consisting of −VB1, −VB2, −VB3 and −VB4 with VC as a reference. Further, Vdisp2 has four levels consisting of −VB5, −VB6, −VB7 and −VB8 with VC as a reference. As a whole, there are provided eight levels of −VB1 to −VB8.

The levels of the positive polarity of VB1, VB2, VB3, VB4, VB5, VB6, VB7 and VB8 do not need to be set at equal intervals, and thus have arbitrary values. Especially, by matching those levels with the characteristics of the liquid crystal, it is possible to perform the color display which is good in the gray scale and provides excellent performance in the white balance. This is also applied to the levels of the negative polarity, similarly. Incidentally, VC can be set at an arbitrary level. Moreover, if VB1 and −VB1 are set to zero in order to construct the system, since the whole voltage levels can be reduced from 16 to 15, this is convenient.

The retention times t1 to t4 of the levels may be set at equal intervals, and thus those are not especially limited. Further, the total time to of the retention times t1 to t4 of the levels may be shorter than the selection time of one horizontal line, i.e., the time of one period of the HSYNC signal, and thus it is not especially limited.

Each of the sampling signals $\phi$l to $\phi$m reaches H level in any one period of t1 to t4 with the value of the second image signal DATA2 (2bits) inputted to the sampling control circuit 11, and as a result, the level of either Vdisp1 or Vdisp2 is selected to be outputted.

After the level of either Vdisp1 or Vdisp2 is selected, this voltage is inputted to the buffer circuits 16A, 16B in timing of the latch signal LA. Each of the buffer circuits is comprised of a circuit device having a low output resistance, and the outputs Vdl to Vdm of the buffer circuits become the display voltages of the display panel 1.

This operation is repeated every horizontal line. Further, in the period of the subsequent frame, the same operations which are the same as those described above are performed in sequence, and thereafter, those operations will be repeated.

Incidentally, the timing when the levels of the sampling signals $\phi$l to $\phi$m are changed from a logical level "H" to another logical level "L" may be determined in such a way as to latch surely a desired voltage. Thus, it is not especially limited. However, by taking an acquisition time of the circuit including the sampling switching circuits 12A, 12B into consideration, if the determination of the timing is performed before the voltage of Vdisp1 or Vdisp1 changes, this is convenient.

Now, the description will be given to an example of the operation of the whole first display voltage generating means 3A and the second display voltage generating means 3B. The levels of the brightness when an image is displayed on the display panel 1 are set to the range of the gradations 1 to 8, and the correspondence between the gradations 1 to 8 and the levels of the source voltages Vdisp1 and Vdisp2 is determined in the form of (VC+VB1) to (VC+VB8) with the frame of odd number while being determined in the form of (VC−VB1) to (VC−VB8) with the frame of even number.

For example, in the case where the gradation 1 is displayed on the display panel 1, each of the sampling signals $\phi$l to $\phi$m is at the H level at time of t1, and the voltage of (VC+VB1) is selected in the period of the frame of odd number while the voltage of (VC−VB1) is selected in the period of the frame of even number. Further, in the case where the gradation 8 is displayed on the display panel 1, the level of each of the sampling signals $\phi$l to $\phi$m reaches H at time of t4, and the voltage of (VC+VB8) is selected in the period of the frame of odd number while the voltage of (VC−VB8) is selected in the period of the frame of even number. This operation is performed with the display voltage points Vdl to Vdm of the display panel 1.

Figure 5:
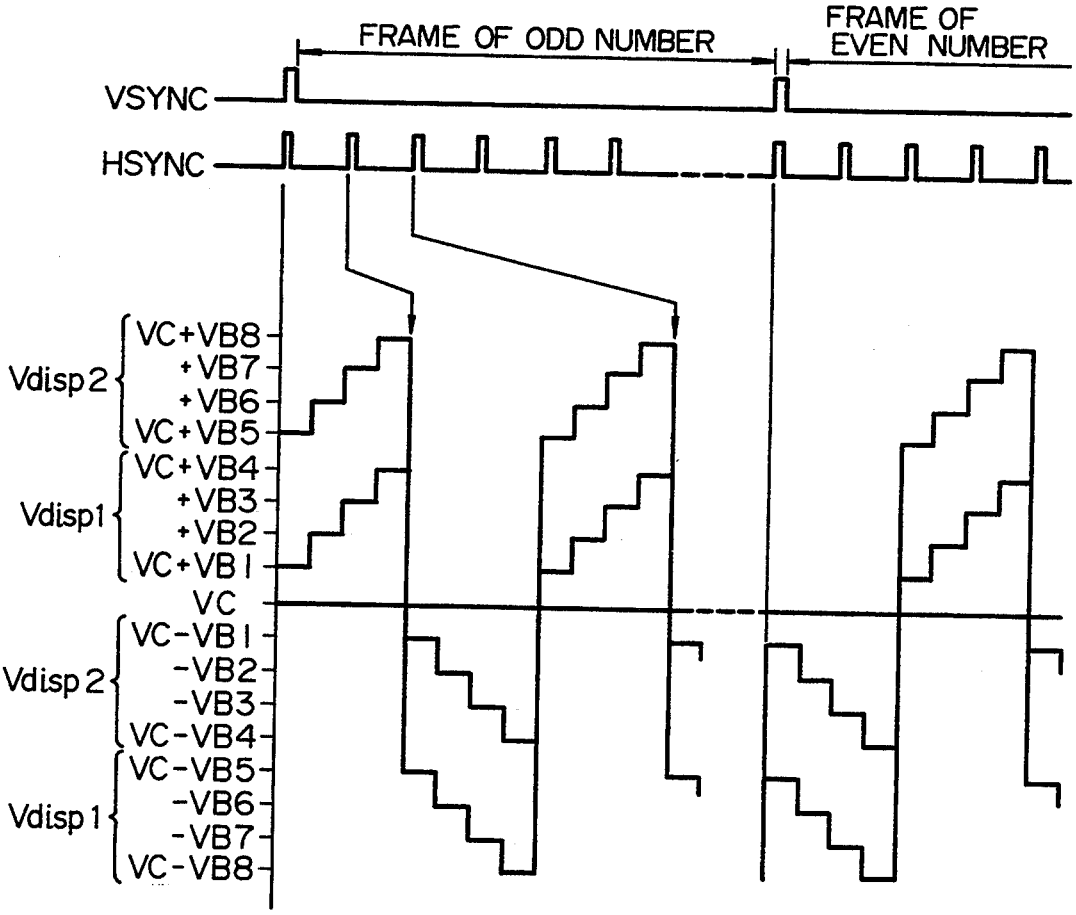
FIG. 5 is a waveform chart giving an example of a source voltage of the display circuit shown in FIG. 3.

Another embodiment of the source voltages Vdisp1 and Vdisp2 is shown in FIG. 5. Although the respective signals are not illustrated in the figure, they are the same as those of FIG. 4; therefore, they are omitted here for brevity. As shown in the figure, the voltage polarity of each of the source voltages Vdisp1 and Vdisp2 is inversed with respect to every line. Moreover, the polarity of the voltage is inversed with the frame of odd number and the frame of even number, so that as a whole, the liquid crystal is a.c.-driven.

While not illustrated in the figure, the voltage waveform shown in FIG. 4 and that shown in FIG. 5 may be suitably mixed with each other. In this case, the flicker of the display panel 1 can be reduced. Any voltage waveform may be available as, long as as a whole, it a.c.-drives the liquid crystal. Thus, the form of the waveform is not especially limited.

Figure 6:
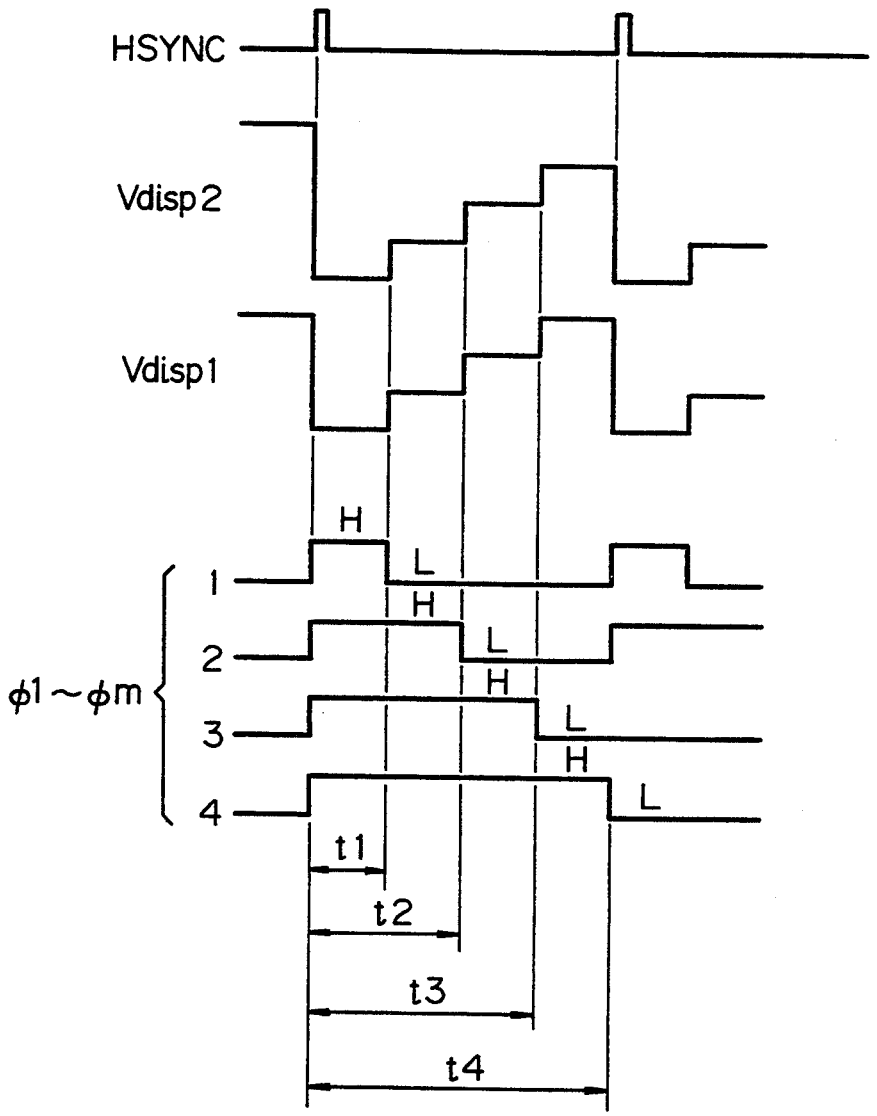
FIG. 6 is a timing chart showing an example of sampling of the source voltage of the display circuit shown in FIG. 3.

Another embodiment of the sampling signals $\phi$l to $\phi$m is shown in FIG. 6. With the sampling signals, the timing when the level changes from H to L in correspondence to the second image signal DATA2 is shifted. Incidentally, the timing when the level changes from H to L may be set in such a way as to securely latch a desired voltage, and thus it is not especially limited.

Figure 7:
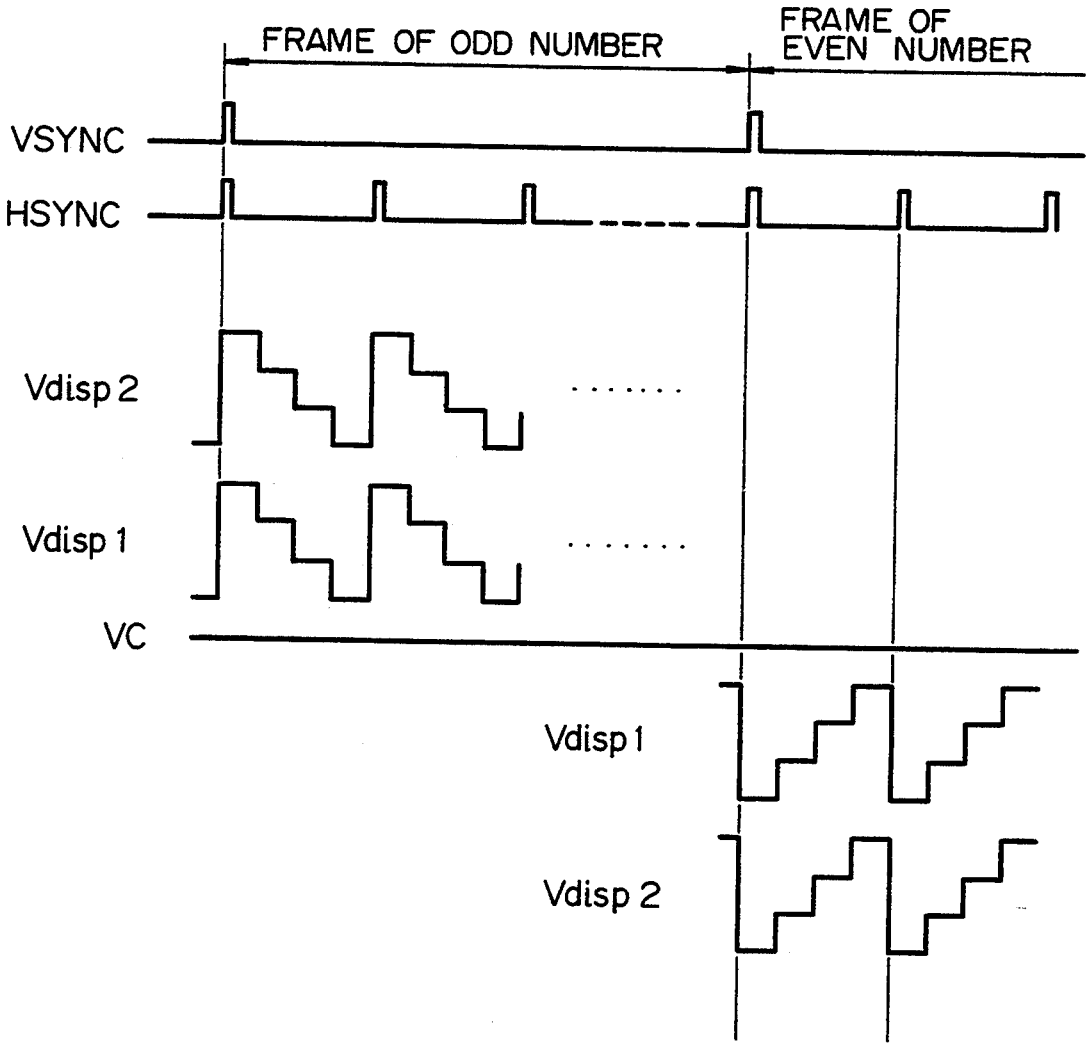
FIG. 7 is a waveform chart showing another embodiment of the source voltage of the display circuit shown in FIG. 3.

Still another embodiment of the source voltages Vdisp1 and Vdisp2 is shown in FIG. 7. The change of the step-like voltage is a waveform which decreases with time in opposition to the cases of FIG. 4 and FIG. 6. If the timing of generating the sampling signals is made to be the same as that of FIG. 4 to FIG. 6, since the light and darkness of the liquid crystal can be reversed, this is convenient.

Figure 8:
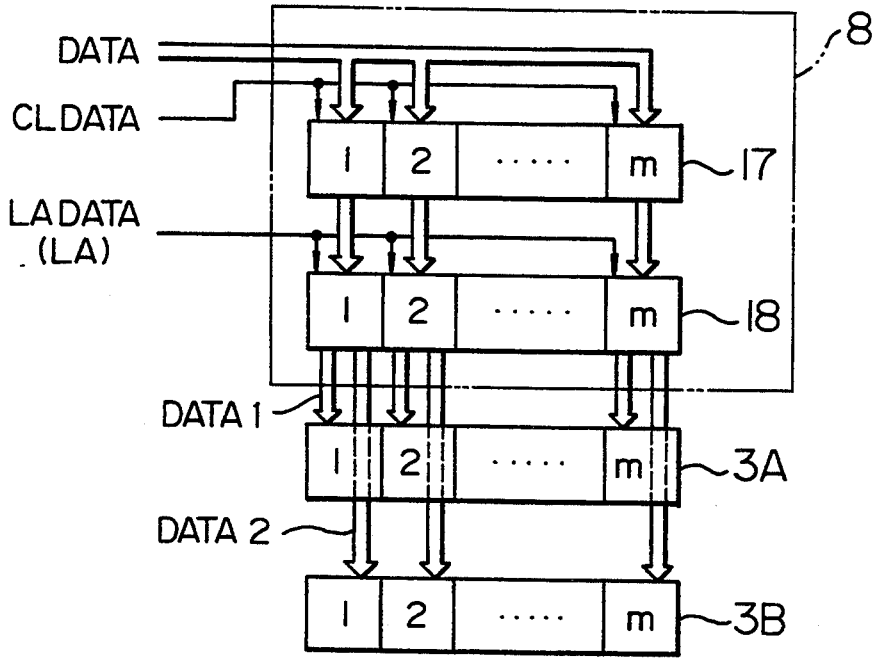
FIG. 8 is a block diagram showing a configuration of one embodiment of the image signal processing circuit shown in FIG. 1.

Next, the description will be given to one embodiment of the image signal processing circuit 8 shown in FIG. 1, referring to FIG. 8. The image signal processing circuit 8 is made up of a first group of latch circuits 17, and a second group of latch circuits 18. Each of the latch circuit groups is made up of m latch circuits so as to correspond to the m dots for one line or one row in the transverse direction of the display panel 1.

An image signal DATA line is connected to the first group of latch circuits 17, and the image signal DATA is latched in each latch circuit in a timing of a clock signal CLDATA.

Moreover, the outputs from the first group of latch circuits 17 are inputted to the second group of latch circuits 18 which latch the respective output signals in a timing of a latch signal LADATA. Now, the latch signal LADATA may be also used as the LA signal shown in FIG. 4.

The image signal which was latched in the second group of latch circuits 18 is divided into a first image signal DATA1 and a second image signal DATA2 in dots, and the resultant signals are inputted to both the first display voltage generating means 3A and the second display voltage generating means 3B. In this case, since the line-at-a-time timing circuit 3C is the same in construction as that of FIG. 1 or FIG. 3, the illustration thereof is omitted here for simplicity.

In the case of the embodiments shown in FIG. 4 to FIG. 7, the first image signal DATA1 is 1 bit and the second image signal DATA2 is 2 bits so that the image signal is 3 bits in total. Therefore, the image signal DATA which is formed in dots is 3 bits of D2, D1 and D0. Out of them, the most significant bit D2 is assigned to the first image signal DATA1, and D1 and DO are assigned to the second image signal DATA2.

Figure 9:
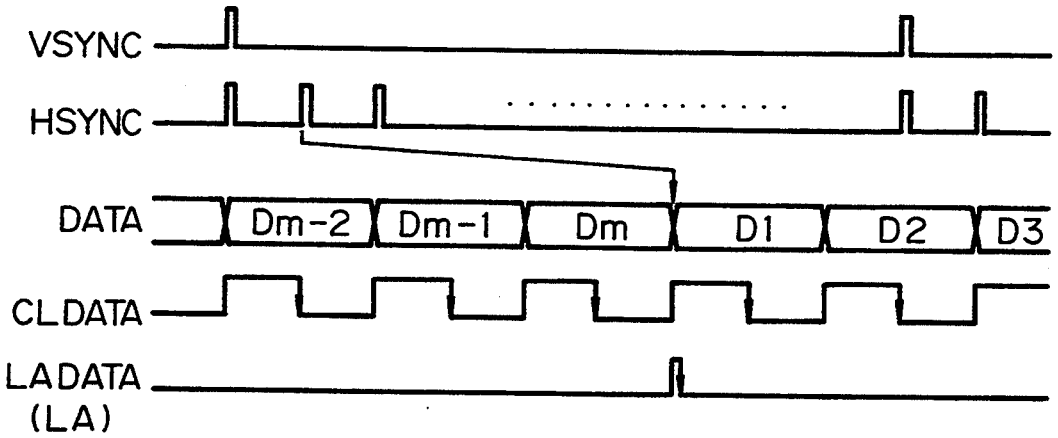
FIG. 9 is a signal timing chart useful in explaining the operation of the circuit shown in FIG. 8.

FIG. 9 is a timing chart showing the operation of the first group of latch circuits 17 and the second group of latch circuits 18. VSYNC and HSYNC are the same as those shown in FIG. 4. The image signal DATA is latched in the latch circuits 1 to m of the first group of latch circuits 17 at each occurrence of a falling edge of CLDATA. After the image signal is latched in the latch circuit m, the image signal is then latched in the second group of latch circuits 18 at each occurrence of a falling edge of the latch signal LADATA.

In the present embodiment, while the method of latching the image signal DATA by the first group of latch circuits 17 is performed in dot, a method may be available in dots. By latching the image signal DATA of plural dots simultaneously, the operating frequency of the circuit can be lowered, and therefore, this is advantageous to the reduction of the power consumption, the lowering of the cost and the like.

Figure 10:
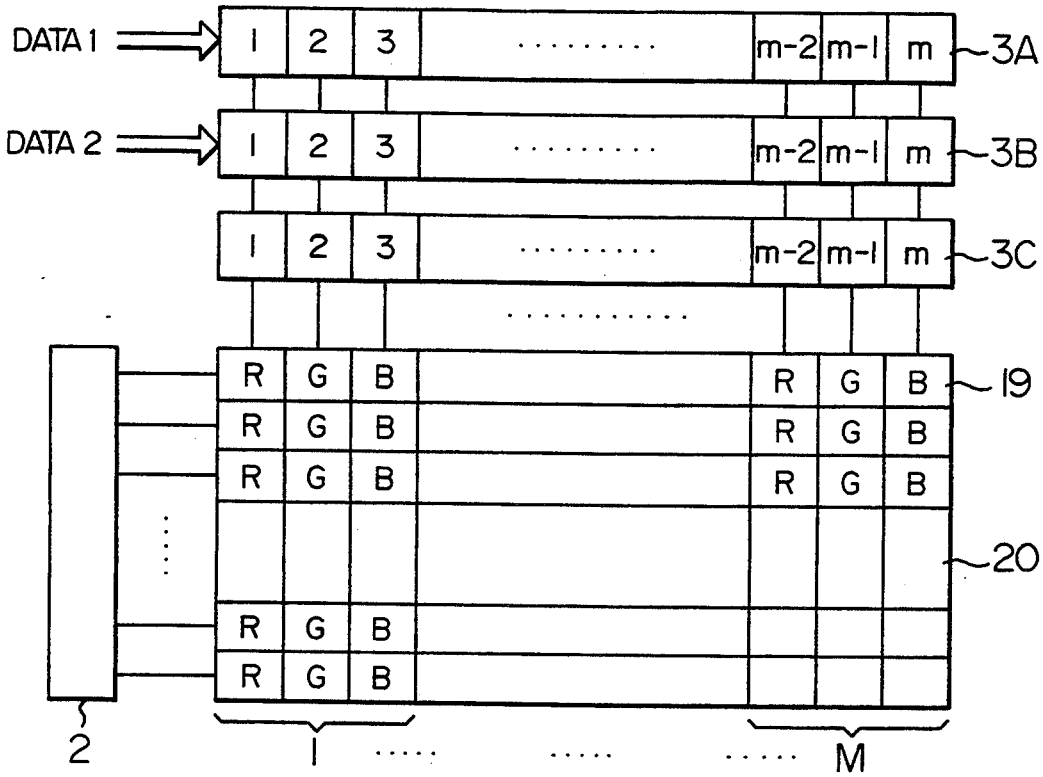
FIG. 10 is a diagram showing an example of connection between the display circuits shown in FIG. 1.

FIG. 10 diagrammatically shows a configuration of an embodiment when a color display panel 20 is driven. Since the components designated by reference numerals 3A, 3B, 3C and 1 are the same as those designated by the same reference numerals shown in FIG. 3, the description thereof will be omitted herein for the sake of simplicity.

The color display panel 20 is made up of plural color dots 19, and with the arrangement thereof, red (R), green (G) and blue (B) are arranged longitudinally. This arranging method is also called the longitudinal stripe.

One picture element is composed of three dots, i.e., red (R), green (G) and blue (B) in total. The M picture elements are arranged transversely. Therefore, the number of dots arranged transversely is 3×M, and correspondingly, the first display voltage generating means 3A, the second display voltage generating means 3B and the line-at-a-time timing circuit 3C are constructed by the circuits having 3×M stages. Now, the method of arranging the color dots 19 is not limited to that shown in FIG. 10. For example, while not illustrated in the figure, a transverse stripe in which the color dots of red (R), green (G) and blue (B) are transversely or laterally arranged may be also available, and thus the arranging method is not limited.

Figure 11:
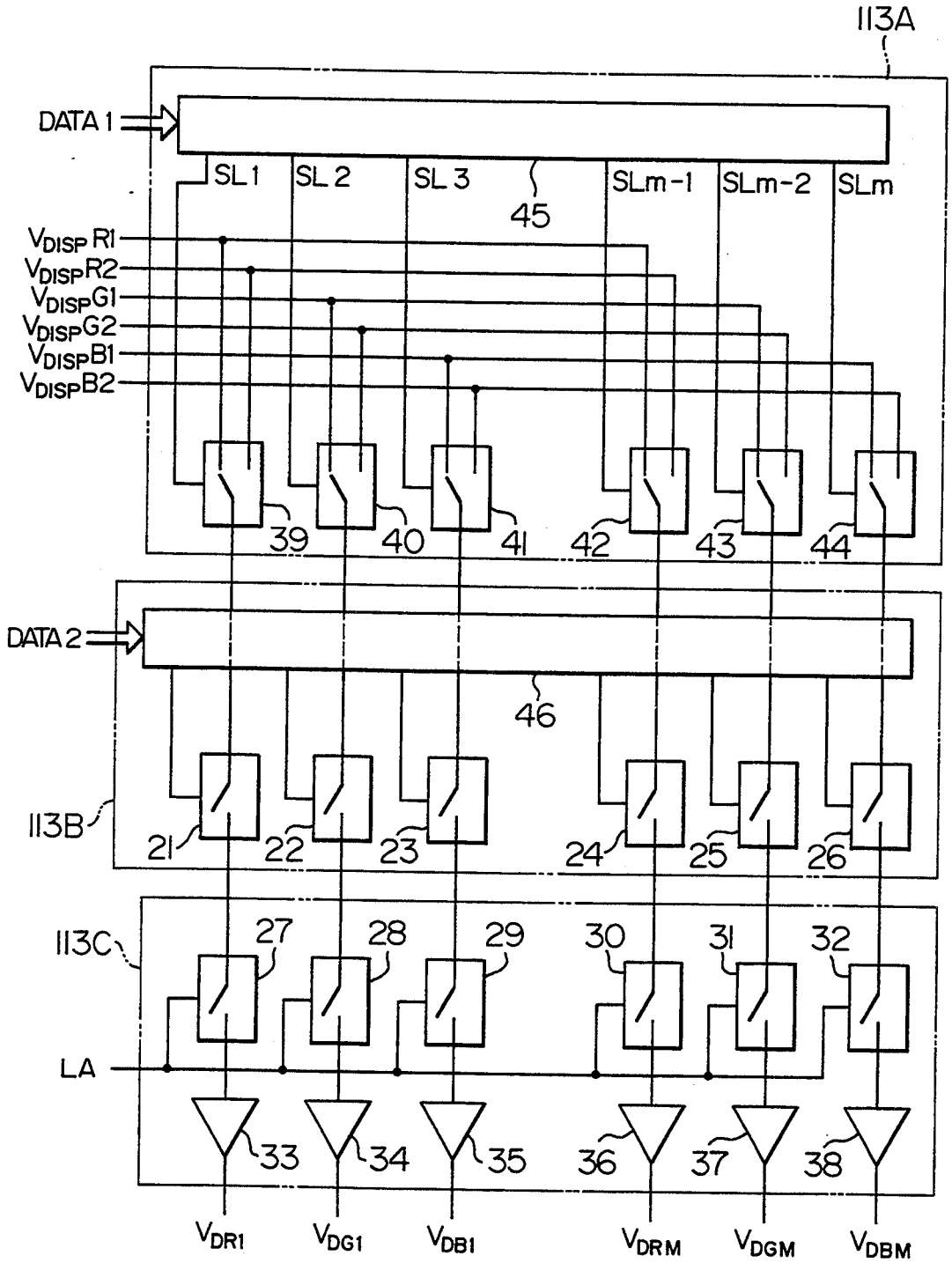
FIG. 11 is a circuit diagram showing another embodiment of the display circuit shown in FIG. 1.

FIG. 11 circuit diagrammatically shows a configuration of another embodiment of first display voltage generating means 113A, second display voltage generating means 113B and a line-at-a-time timing circuit 113C. The first display voltage generating means 113A is made up of a selection signal generating circuit 45 and voltage selecting circuits 39 to 44.

The selection signal generating circuit 45 generates m selection signals SL1 to SLm. Moreover, the source voltages VdispR1 and VdispR2, VdispG1 and VdispG2, and VdispB1 and VdispB2 are inputted to the voltage selection circuit 39, the voltage selection circuit 40, and the voltage selection circuit 41, respectively. Hereinafter, the source voltages are inputted to the voltage selecting circuits in this order with corresponding thereto.

If VdispR1 and VdispR2, VdispG1 and VdispG2, and VdispB1 and VdispB2 are made to correspond to the color dots of red (R), the color dots of green (G), and the color dots of blue (B), respectively, since the voltage can be set for every color, this is convenient. In this case, the selection signals SL1, SL2 and SL3 correspond to the image signal of red (R), the image signal of green (G), and the image signal of blue (B), respectively. Thereafter, this relationship is repeated.

Moreover, the second display voltage generating means 113B is made up of a sampling control circuit 46 and switching circuits 21 to 26, and the line-at-a-time timing circuit 113C is made up of switching circuits 27 to 32 and buffer circuits 33 to 38. The output voltages $V_{DR1}$ of the buffer circuit 33 corresponds to red (R) shown in FIG. 10, and $V_{DG1}$ and $V_{DGM}$ correspond to green (G) and blue (B), respectively. Hereinafter, with this relationship, $V_{DRM}$, $V_{DGM}$ and $V_{DGM}$ of the buffer circuits 36, 37 and 38 correspond to red (R), green (G) and blue (B), respectively.

Since the operations of the second display voltage generating means 113B and the line-at-a-time timing circuit 113C are the same as the operation of the timing circuit 3C, the detailed description thereof is omitted here for brevity. In the figure, the components, which have the same function as that of the capacitors 13A, 13B, 15A and 15B shown in FIG. 3, are not illustrated. The embodiment of FIG. 11 can finely adjust the display for voltage every color and can constitute the driving device which is suitable for the liquid crystal color display.

Figure 12:
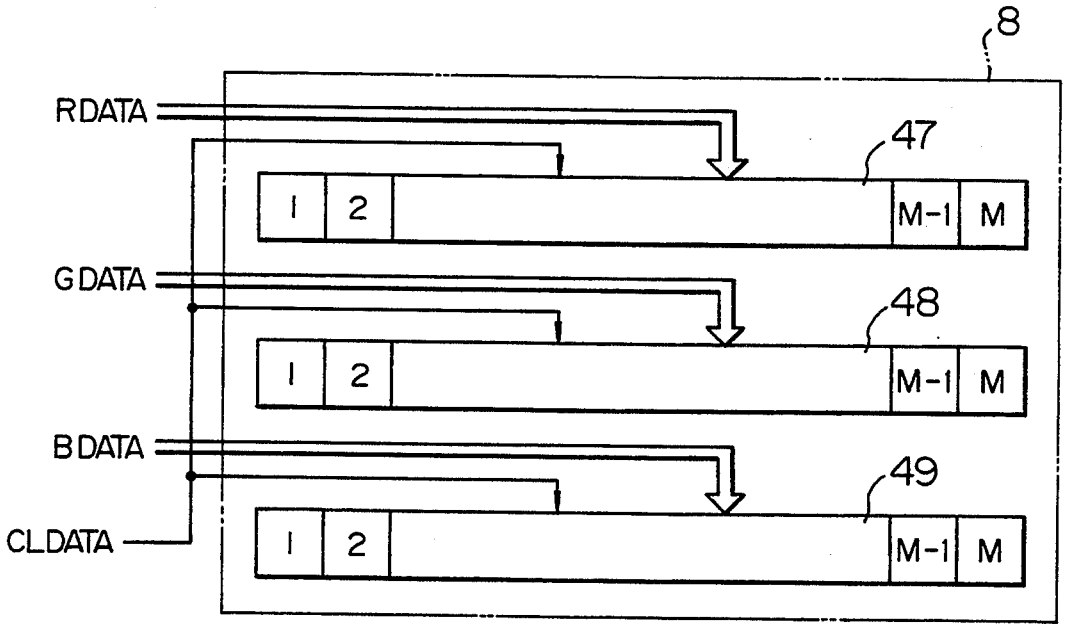
FIG. 12 is a diagram showing one embodiment of the image signal processing circuit shown in FIG. 11.

Next, FIG. 12 diagrammatically shows an arrangement of another embodiment of the image signal processing circuit 8 shown in FIG. 1. The image signal processing circuit 8 is made up of three circuits, i.e., processing circuits 47, 48 and 49. In this connection, the processing circuits 47, 48 and 49 correspond to red (R), green (G) and blue (B), respectively. Therefore, the image signals of red (R), green (G) and blue (B) are inputted to the processing circuits 47, 48 and 49 independently of one another. Those image signals are latched in the associated circuits in accordance with the timing of the clock signal CLDATA. Since the operation at this time is the same as that of FIG. 9, the detailed description is omitted here for brevity. Incidentally, the latch of the image signal by the clock signal CLDATA may be performed either in dot or in dots with respect to every color, and thus the number of dots latched by one clock of CLDATA is not especially limited.

While not illustrated, the image signal of each color which has been latched in the image signal processing circuit 8 is divided into the first image signal DATA1 and the second image signal DATA2 for every color, and then the resultant signals are inputted to the first display voltage generating means 3A and the second display voltage generating means 3B, respectively. If the display panel 1 is a color panel in which the number of picture elements transversely arranged is M as shown in FIG. 10, each of the processing circuits 47 to 49 is made up of M circuits. Those circuits may be circuits which are capable of processing the gray scale, and thus the manner of arranging the circuits is not especially limited.

Figure 13:
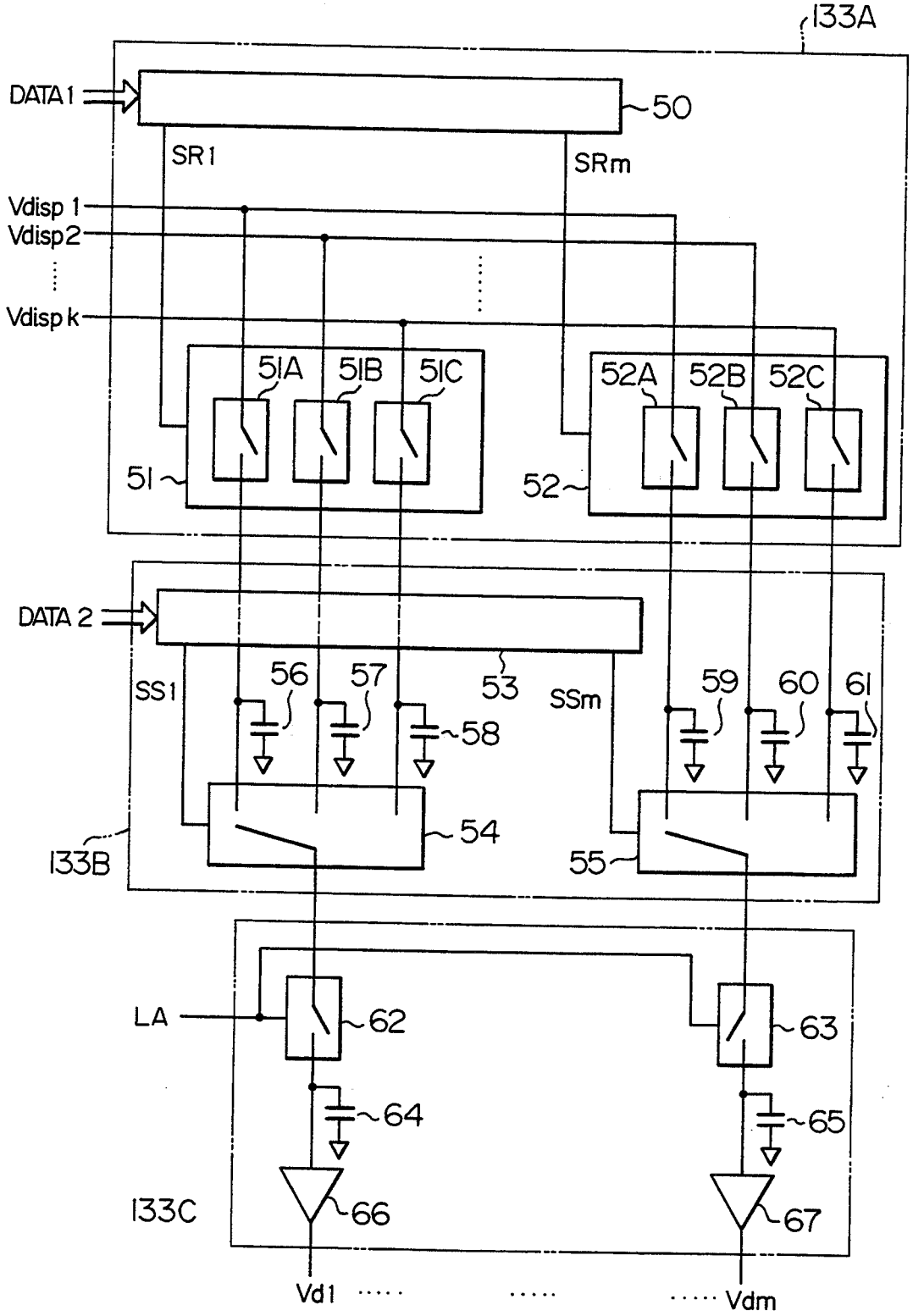
FIG. 13 is a circuit diagram showing a configuration of still another embodiment of the display circuit according to the present invention.

FIG. 13 shows another embodiment of the first display voltage generating means 3A, the second display voltage generating means 3B and the line-at-a-time timing circuit 3C shown in FIG. 1 which are correspondingly shown herein as 133A, 133B and 133C, respectively. The first display voltage generating means 133A is made up of a sampling control circuit 50 and sampling switching circuit groups of m stages 51, 52, and thus includes the sampling switching circuit groups which have m stages in total. Further, the sampling switching circuit groups 51, 52 are made up of switches 51A, 51B and 51C, and switches 52A, 52B and 52C. In this connection, each sampling switching circuit group includes K switches in total.

The source voltage Vdisp1 is inputted to the switch 51A of the sampling switching circuit group 51, and hereinafter, the source voltages Vdisp2, Vdisp3, . . . , Vdispk are inputted to the associated switches. Hereinafter, to the sampling switching circuit groups having the m stages, which are omitted in the figure, inputted the source voltages which are the same as those of the sampling switching circuit group 51.

The switch 51A, the switch 51B and the switch 51C are turned on by the sampling signals SR1 to SRm from the sampling control circuit 50 to latch the above source voltages in the specific timing.

The second display voltage generating means 133B is made up of a selection signal generating circuit 53, capacitors 56 to 61, and voltage selecting circuits 54, 55. The voltage selecting circuits 54, 55 are arranged so as to correspond to the above sampling switching circuit groups and have the m circuits in total. Each of the voltage selecting circuits selects one voltage out of the m voltages, which were sampled by the sampling switching circuit groups, by receiving one of the selection signals SSl to SSm from the selection signal generating circuits 53 to output it.

Further, the line-at-a-time timing circuit 133C is made up of switches 62, 63, capacitors 64, 65 and buffer circuits 66, 67. Each set of the switching circuits 62, 63, the capacitors 64, 65, and the buffer circuits 66, 67 is comprised of the m components or devices.

Incidentally, the capacitors 56 to 61 may be formed in an IC form when the circuit shown in FIG. 13 is formed in a monolithic IC. Alternatively, as the capacitances of those capacitors, the capacitances of the outputs of the sampling switching circuit groups 51, 52, the capacitances of the inputs of the voltage selecting circuits 54, 55, the capacitances of the wiring or the combination thereof may be utilized. Thus, the construction method thereof is not especially limited. This is also applied to the capacitors 64, 65.

Moreover, the buffer circuits 66, 67 may be also omitted. Further, while not illustrated in the figure, the buffer circuits may be provided in the output terminals of the sampling switching circuit groups 51, 52, or the input terminals of the voltage selecting circuits 54, 55 for receiving the output voltages of the sampling switching circuit groups 51, 52, and both the terminals. As a result, since the source voltage which has been sampled can be further stabilized, this is convenient.

The description will be given to the operation of the circuits shown in FIG. 13, and the voltages of the sections, referring to FIG. 14. The relationship between HSYNC, VSYNC and the scanning voltage of the display panel 1 is the same as that of FIG. 4. While the number of source voltages Vdispl to Vdispk inputted to the sampling switching circuit groups 51, 52 may be an arbitrary number, k=2 is set in the present embodiment. Moreover, in the present embodiment, the number of gradations of the image displayed on the display panel 1 is set to 8.

The source voltage Vdisp1 is changed in steps with time in the frame of even number, and consists of four levels, i.e., (VC+VB1), (VC+VB2), (VC+VB3) and (VC+VB4). This state of the voltage may be set in the period of the selection time to of one line, or within this time, and thus it is not especially limited. The above voltage states are hereinafter provided in the selection times. Moreover, the source voltage changes in steps in the frame of odd number similarly to the frame of even number, and consists of four levels, i.e., (VC−VB1), (VC−VB2), (VC−VB3) and (VC−VB4).

Moreover, the source voltage Vdisp2 consists of four levels, i.e., (VC+VB5), (VC+VB6), (VC+VB7) and (VC+VB8) in the frame of even number. In the frame of odd number, it consists of four levels, i.e., (VC−VB5), (VC−VB6), (VC−VB7) and (VC−VB8).

As a whole, each of the source voltages Vdisp1 and Vdisp2 is composed of the eight levels. Besides, since the form of the voltage is the same as that of FIG. 4, the detailed description thereof is omitted here.

Figure 14:
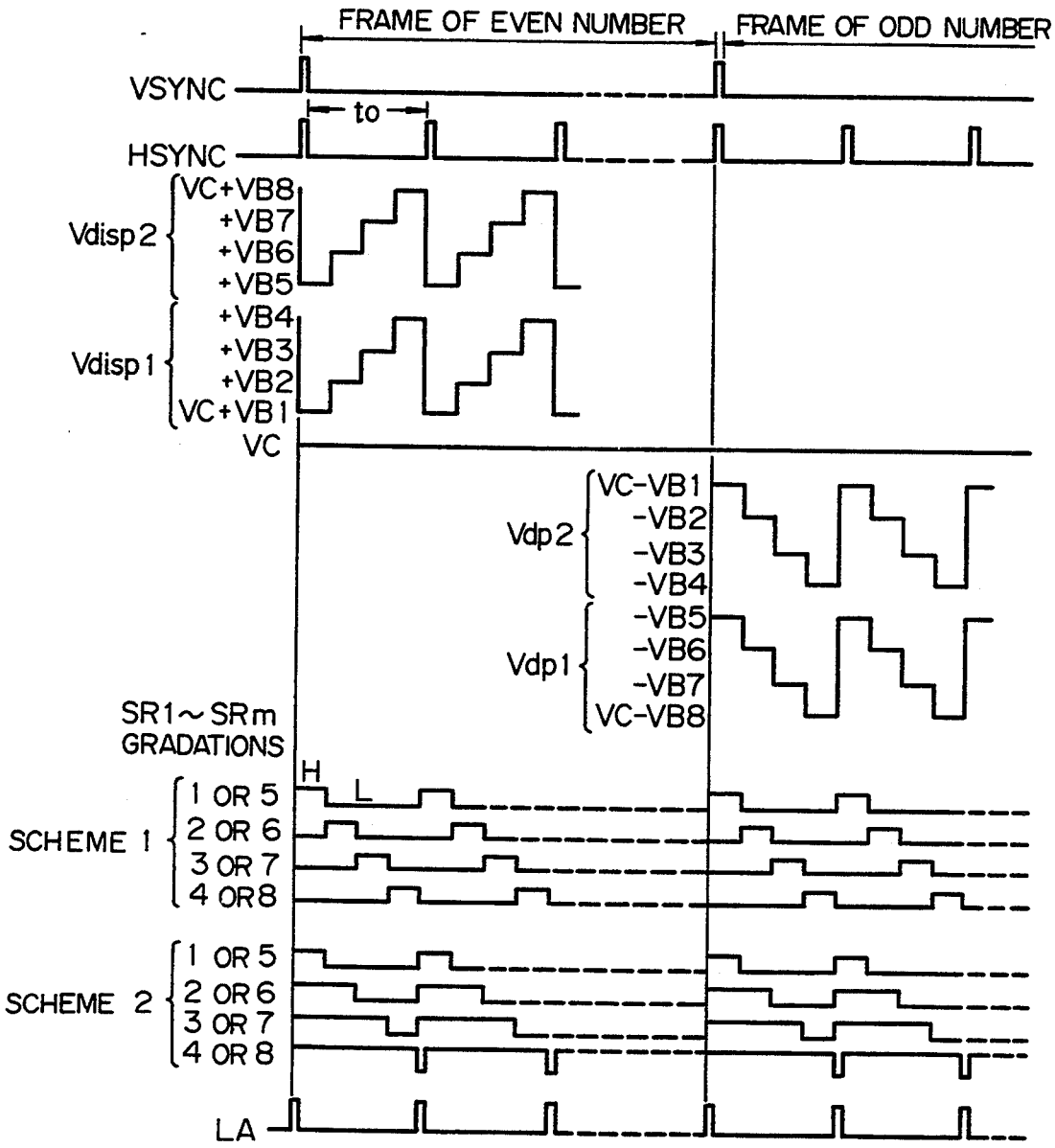
FIG. 14 is a timing chart showing an example of the operation of the display circuit shown in FIG. 13.

The sampling signals SR1 to SRm take, as shown in FIG. 14, two schemes, i.e., a scheme 1 wherein the period of the H level changes in correspondence to the contents of the image signal DATA1 (3 bits) and a scheme 2 wherein the width of the H level changes (increases) in correspondence to the contents of the image signal DATA1. In both the cases, the levels of the source voltages Vdisp1 and Vdisp2 when changing from H to L become the output voltages of the sampling switch groups.

Now, for the levels of VC+VB1 (VC−VB1) to VC+VB8 (VC−VB8), the gradations are made to correspond to 1 to 8. In this case, as shown in FIG. 14, in both the schemes 1 and 2, each of the output voltages of the sampling switching circuit groups takes one of the gradation 1 or the gradation 5 (a first state), the gradation 2 or the gradation 6 (a second state), the gradation 3 or the gradation 7 (a third state), and the gradation 4 or the gradation 8 (a fourth state). With the correspondence between the states and the first image signal DATA1, assuming that the most significant bit is D1, and the least significant bit is D0, D1=0 and D1=0, D1=0 and D1=1, D1=1 and D1=0, and D1=1 and D1=1 can correspond to the first state, the second state, the third state, and the fourth state, respectively. However, this correspondence is not especially limited.

The source voltages which have been sampled by the sampling switching circuit groups are inputted to the voltage selecting circuits 54. The voltage selecting circuits 54 selects among the output signals of the sampling switching circuit groups 51 with the selection signals SSl to SSm from the voltage selection control circuit 53.

In the present embodiment, the number of outputs from each sampling switch group is 2 (k=2). With each output, the level of the gradation 1 or gradation 5, the level of the gradation 2 or gradation 6, the level of the gradation 3 or gradation 7, and the level of the gradation 4 or gradation 8 are generated in the first state, the second state, the third state, and the fourth state, respectively. Then, the voltage selecting circuit selects one of the gradations in each state by the control of the selection signals (1 bit).

Thus, one of the first to fourth states is selected by the first display voltage generating means 133A, and then one of the gradations in each state is selected by the second display voltage generating means 133B. The voltage levels of the eight gradations can be generated by those two means. Incidentally, the number of gradations may take even a number other than the eight gradations, and thus it is not especially limited.

Figure 15:
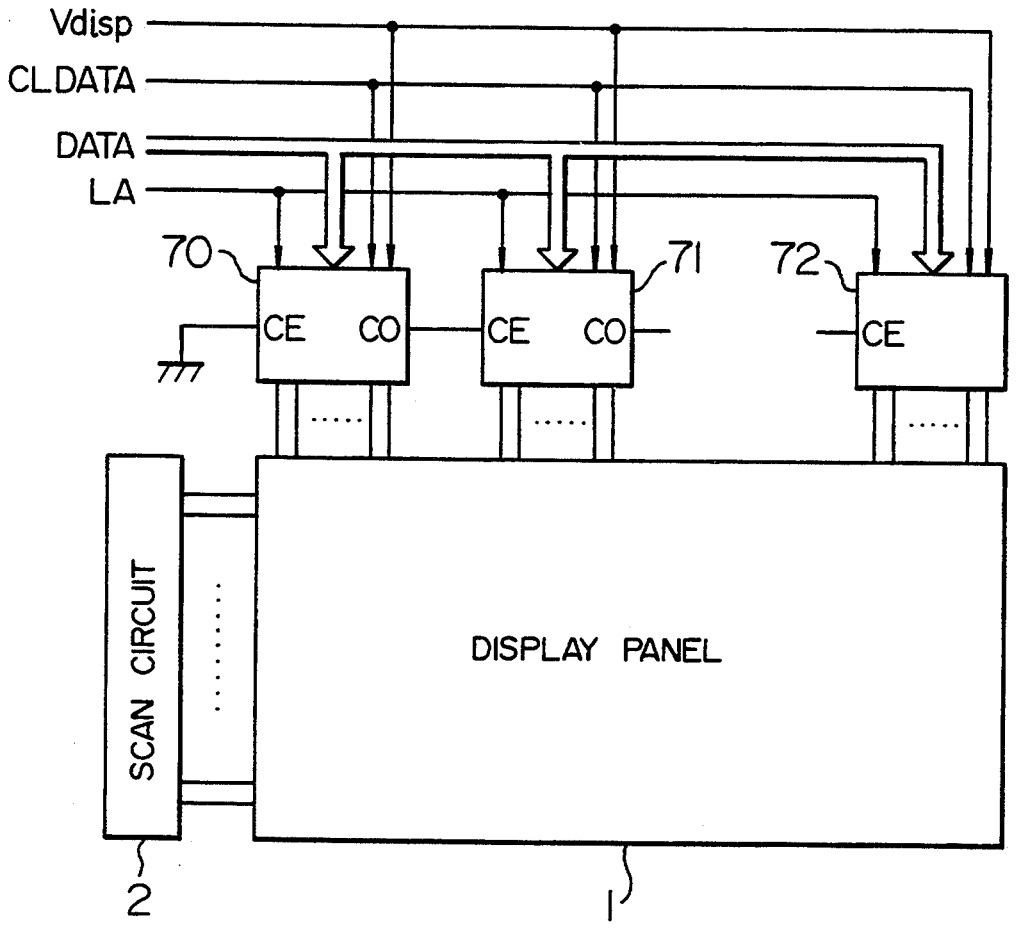
FIG. 15 is a block diagram showing an example of a configuration of the display in the case where an integrated circuit of the display circuit according to the present invention is employed.
Figure 16A:
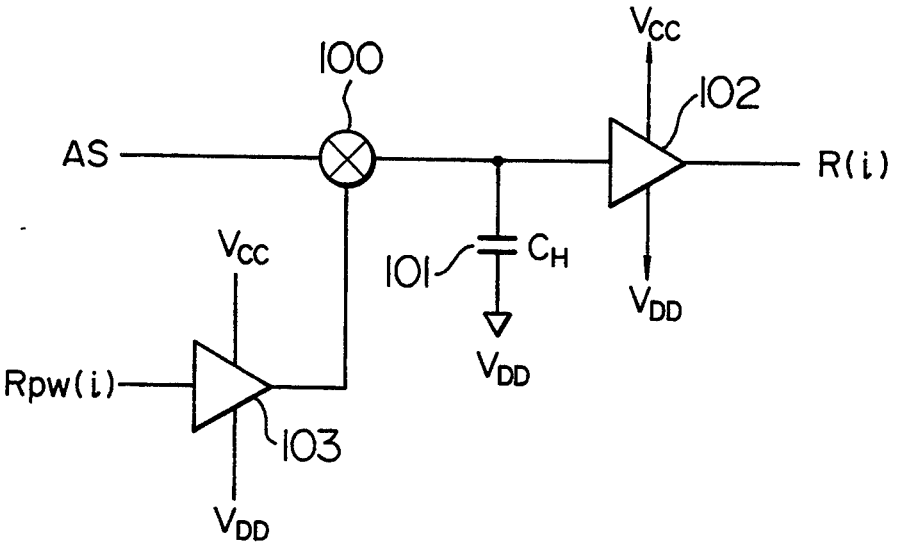
FIG. 16A PRIOR ART
FIG. 16A and FIG. 16B are respectively a circuit diagram giving an example of the prior art display, and a waveform chart useful in explaining the operation of the prior art display.
Figure 16B:
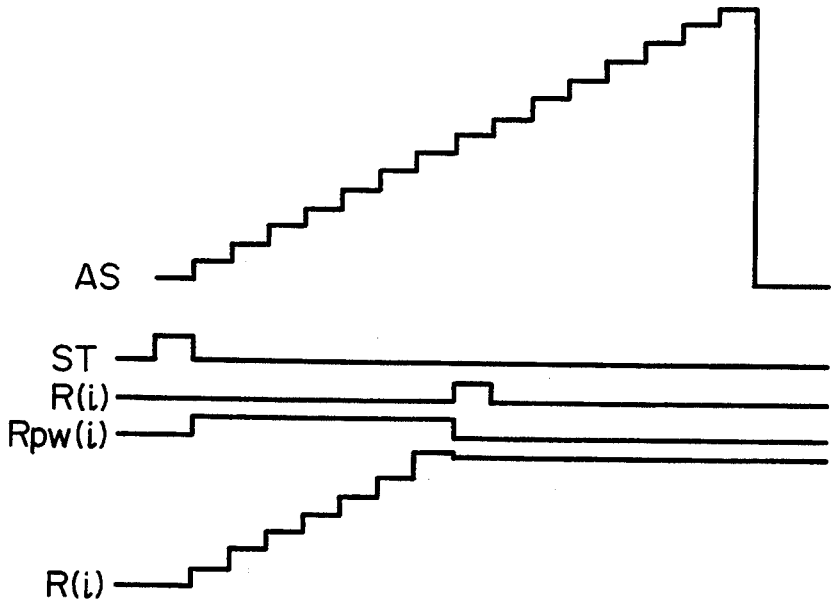
FIG. 16B PRIOR ART

FIG. 15 shows an example of a configuration of the display when an integrated circuit in which the display circuit according to the present invention is integrated is employed. The present display is made up of integrated circuits of plural display circuits 70, 71, 72, the display panel 1, and the scanning circuit 2. Incidentally, in the figure, the control circuit and the external system are omitted here for brevity. At least the source voltage Vdisp, the clock signal CLDATA, the image signal DATA and the latch signal LA are inputted to the integrated circuits 70, 71, 72.

Moreover, each integrated circuit includes a chip enable terminal CE and an output terminal CO, and by connecting those terminals to each other, each integrated circuit is operated.

As an embodiment of the present invention, in addition to the above-mentioned systems, any other system may be available as long as it is constructed in such a way as to shorten the sampling time for one gradation or simplify the circuit. Thus, the system is not especially limited as long as it fulfills the circuit arrangement on the side of the display circuit shown in FIG. 1. As a result, the speed of latching the source voltage can be decreased. Therefore, for example, the size of the sampling switch which is comprised of FET such as N-MOS or P-MOS, or TFT made of a-Si or p-Si can be further reduced, the noise due to the sampling signal can be reduced, and the signal-to-noise (S/N) ratio can be improved. As a result, the variation of the voltage (display voltage) across the output terminals of the buffer circuit is decreased, and it is possible to prevent the fixed noise pattern from being displayed on the display panel.

Moreover, with the buffer circuit in the display circuit of the embodiment shown in FIG. 3, even the relationship of the voltage amplification $\neq 1$ (GAIN $\neq 1$) is available. For example, if the buffer circuit having the relationship of the voltage amplification $>1$ is employed, the voltage up to the input terminal of the buffer circuit can be decreased, and the low power consumption and high reliability of the circuit can be realized. In addition, especially, in the case where the display circuit is integrated, the process cost for the integration can be further decreased, and the low cost of the display can be achieved.

The display circuit may be integrated in such a way that only the buffer circuit is formed of discrete components, or may be integrated and thereby be paired with the integrated circuit of the display circuit except the buffer circuit to construct the whole display circuit. Thus, the construction method thereof is not especially limited. Moreover, in the case where the display circuit is integrated, the circuit for generating the source voltage Vdisp shown in FIG. 3 may be arranged in the internal portion of the integrated circuit. Thus, the arrangement method, and the concrete construction of the circuit are not especially limited. Such method and contruction schemes can similarly be applied to the embodiments shown in FIG. 11 and FIG. 13.

Moreover, in the present embodiment, since the greater part of the display circuit can be constructed in the digital form, the high reliability of the system can be realized and also the maintenance can be readily performed. In addition thereto, the system can be constructed in such a way as to provide excellent performance in suitability for various digital communication systems and devices.

When the display is constructed, the component for adjusting the level of the source voltage Vdisp is added to the system to provide the facility of finely adjusting the brightness, whereby it is possible to provide the system having a high added value. In this case, while not illustrated in the figure, conveniently, the external system is designed in such a way as to be able to adjust the brightness in conjunction with or independently of a back light for lighting the display panel.

A part of the circuit shown in FIG. 3, FIG. 11 and FIG. 13 may be integrated with the display panel. In this case, the part may be also formed together with the elements of the display section.

According to the present invention, the drive circuit for displaying an image having a gray scale on the matrix panel can be constructed by a simple circuit, and the speed of the operation for generating the display voltages can be readily decreased. Therefore, the display device of high resolution and multi-color display having a great number of display picture elements, such as HDTV, CAD, CAE and a graphic display, can be readily realized.

Moreover, since the low speed of the operation of the circuit can be realized, especially, in the case where the circuit is integrated, the reduction of the area of the components and the high integration thereof can be readily attained. Therefore, the chip of the drive circuit can be miniaturized and the cost thereof can be lowered. As a result, the miniaturization and the low cost of the display can be promoted. Further, since the variation of the output voltage across the output terminals can be reduced, the image display of high picture quality which is free from the lack of uniformity of the display can be provided.

Moreover, since the control of the display of the gray scale in each of the colors R, G and B can be readily performed, the color reproduction, the color tone and the like of the displayed image are excellent, and those characteristics can be readily, finely adjusted by the component or components mounted to the external portion of the display. Therefore, the display can be constructed in such a way as to provide excellent performance in handling. Further, even in the case where the control of the display of the gray scale is performed by the external system, the circuit arrangement and the system configuration can be simplified. Accordingly, the high reliability and the low cost of the system can be enhanced.

Further, since the system of multi-color display can be readily constructed, it is possible to construct the display device of compound facility which has the facility of displaying information, such as a computer, as well as the facility of displaying a natural picture, such as a television.

Further, since the greater part of the display system including the drive circuit can be operated using the digital signals, it is possible to construct the display system which is easy in maintenance and is excellent in reliability, and provides excellent performance in adaptability for the digital communication system, such as LAN (Local Area Network) and INS (Information Network System), and the digital information device, such as an IC card and a ROM card.

What is claimed is:

1. A display device including scanning electrodes, display electrodes, a display panel on which display dots are formed, with respect to a plan view, at intersections between said scanning electrodes and said display electrodes, a display electrode drive circuit generating a display voltage for each display dot in correspondence to an input digital image signal and applying the same to a respective display electrode, and a scanning electrode drive circuit generating a scanning voltage, said display electrode drive circuit comprising:

means for dividing said input digital image signal into at least a first bit image signal and a second bit image signal for each display dot;

first display voltage generating means, coupled to the dividing means, for selecting one of plural source voltages which have values that periodically vary independently of said input digital image signal in accordance with said first bit image signal; and second display voltage generating means coupled to said first display voltage generating means and the dividing means for sampling an output signal of said first display voltage generating means in accordance with contents of said second bit image signal to thereby provide a display voltage for a respective display electrode.

2. A display device according to claim 1, wherein information of a gradation of a picture element formed of the display dot is included in said first bit image signal and/or said second bit image signal.

3. A display device including scanning electrodes, display electrodes, a display panel on which display dots are formed, with respect to a plan view, at intersections between said scanning electrodes and said display electrodes, a display electrode drive circuit generating a display voltage for each display dot in correspondence to an input digital image signal and applying the same to a respective display electrode, and a scanning electrode drive circuit generating a scanning voltage, said display electrode drive circuit comprising:

means for dividing said input digital image signal into at least a first bit image signal and a second bit image signal for each display dot;

first display voltage generating means, coupled to receive said first bit image signal and plural source voltages which have values that vary at a predetermined period independently of said input digital image signal, for sampling each of said plural source voltages in accordance with contents of said first bit image signal and provide output signals based on sampling results; and second display voltage generating means coupled to receive said second bit image signal and said output signals of said first display voltage generating means for selecting each of the output signals of said first display voltage generating means in accordance with contents of said second bit image signal to thereby provide a display voltage for a respective display electrode.

4. A display device according to claim 3, wherein at least one source voltage inputted to said first display voltage generating means includes plural gradation voltages for driving a picture element of the display dot.

5. A display device including scanning electrodes, display electrodes, a display panel on which display dots are formed, with respect to a plan view, at intersections between said scanning electrodes and said display electrodes, a display electrode drive circuit generating a display voltage for each display dot in correspondence to an input digital image signal and applying the same to a respective display electrode, and a scanning electrode drive circuit generating a scanning voltage, said display electrode drive circuit comprising:

a first data latch circuit latching an input digital image signal in a predetermined timing at least in units of dot;

a second data latch circuit latching simultaneously the digital image signals latched in said first data latch circuit, synchronously with a timing of a line-at-a-time driving operation of the scanning circuit;

means for dividing each of said digital image signals latched in said second data latch circuit into at least a first bit image signal and a second bit image signal in units of display dot;

first display voltage generating means, coupled to receive said first bit image signal and plural source voltages which have values that periodically vary independently of said input digital image signal, for selecting one of said plural source voltages in accordance with said first bit image signal;

second display voltage generating means, coupled to receive plural output signals of said first display voltage generating means and said second bit image signal from the dividing means, for sampling the plural output signals of said first display voltage generating means in accordance with contents of said second bit image signal to thereby provide display voltages for the respective display electrodes; and a line-at-a-time timing circuit outputting output signals from said second display voltage generating means synchronously with a timing of a line-at-a-time driving operation of the scanning circuit.

6. A display device according to claim 5, wherein said source voltage has a weighted waveform matching with electrooptic characteristics of a liquid crystal.

7. A display device according to claim 5, wherein said source voltage has a step-like waveform.

8. A display device according to claim 5, wherein a buffer circuit having an arbitrary voltage amplification is connected to the output side of said line-at-a-time timing circuit.

9. A display device according to claim 8, wherein said buffer circuit includes capacitors connected to the input side thereof.

10. A display device according to claim 5, wherein said second display voltage generating means includes capacitors connected to the output side thereof.

11. A display device including scanning electrodes, display electrodes, a display panel on which display dots are formed, with respect to a plan view, at intersections between said scanning electrodes and said display electrodes, a display electrode drive circuit generating a display voltage for each display dot in correspondence to an input digital image signal and applying the same to the respective display electrode, and a scanning electrode drive circuit generating a scanning voltage to thereby display an image on said display panel, said display electrode drive circuit comprising:

a first data latch circuit latching an input digital image signal in a predetermined timing at least in units of dot;

a second data latch circuit latching simultaneously digital image signals latched in said first data latch circuit, synchronously with a timing of a line-at-a-time driving operation of the scanning circuit;

means for dividing each of said digital image signals latched in said second data latch circuit into at least a first bit image signal and a second bit image signal in units of display dot;

first display voltage generating means, coupled to receive said first bit image signal and plural source voltages which have values that vary at a predetermined period independently of said input digital image signal, for sampling each of said plural source voltages in accordance with said first bit image signal to provide output signals;

second display voltage generating means, coupled to receive plural output signals of said first display voltage generating means and said second bit image signal from the dividing means, for selecting each of the plural output signals of said first display voltage generating means in accordance with contents of said second bit image signal to thereby provide display voltages for the respective display electrodes; and a line-at-a-time timing circuit outputting output signals from said second display voltage generating means synchronously with a timing of a line-at-a-time driving operation of the scanning circuit.

12. A display device according to claim 11, wherein said second display voltage generating means includes capacitors connected to the output side thereof.

13. A display device including scanning electrodes, display electrodes, a display panel on which display dots are formed, with respect to a plan view, at intersections between said scanning electrodes and said display electrodes, a display electrode drive circuit generating a display voltage for each display dot in correspondence to an input digital color image signal and applying the same to a respective display electrode, and a scanning electrode drive circuit generating a scanning voltage, thereby displaying a color image on said display panel, said display electrode drive circuit comprising:

a first data latch circuit latching an input digital color image signal in a predetermined timing at least in units of dot;

a second data latch circuit latching simultaneously digital color image signals latched in said first data latch circuit, synchronously with a timing of a line-at-a-time driving operation of the scanning circuit;

means for dividing each of said digital color image signals latched in said second data latch circuit into at least a first bit image signal and a second bit image signal in units of display dot;

first display voltage generating means, coupled to receive said first bit image signal and plural source voltages which have values that vary at a predetermined period independently of said input digital color image signal, for sampling each of said plural source voltages in accordance with said first bit image signal to provide output signals;

second display voltage generating means, coupled to receive plural output signals of said first display voltage generating means and said second bit image signal from the dividing means, for selecting each of the plural output signals of said first display voltage generating means in accordance with contents of said second bit image signal to thereby provide display voltages for the respective display electrodes; and a line-at-a-time timing circuit outputting output signals from said second display voltage generating means synchronously with a timing of a line-at-a-time driving operation of the scanning circuit.

14. A display device according to claim 13, wherein said source voltages are grouped so as to correspond to the color signals and are voltages corresponding to three colors consisting of red, green and blue.

15. A display device including scanning electrodes, display electrodes, a display panel on which display dots are formed, with respect to a plan view, at intersections between said scanning electrodes and said display electrodes, a display electrode drive circuit generating a display voltage for each display dot in correspondence to a digital color image signal and applying the same to the respective display electrode, and a scanning electrode drive circuit generating a scanning voltage, said display electrode drive circuit comprising:

a first data latch circuit latching an input digital color image signal in a predetermined timing at least in units of dot;

a second data latch circuit latching simultaneously digital color image signals latched in said first data latch circuit, synchronously with a timing of a line-at-a-time driving operation of the scanning circuit;

means for dividing each of said digital image signals latched in said second data latch circuit into at least a first bit image signal and a second bit image signal in units of display dot;

first display voltage generating means, coupled to receive said first bit image signal and plural source voltages of which the values periodically vary independently of said digital color image signals, for selecting one of said plural source voltages in accordance with said first bit image signal;

second display voltage generating means, coupled to receive plural output signals of said first display voltage generating means and said second bit image signal from the dividing means, for sampling the plural output signals of said first display voltage generating means in accordance with contents of said second bit image signal to thereby provide display voltages for the respective display electrodes; and a line-at-a-time timing circuit outputting output signals from said second display voltage generating means synchronously with a timing of a line-at-a-time driving operation of the scanning circuit.

16. A display electrode drive circuit for use in a display device including scanning electrodes, display electrodes, a display panel on which display dots are formed, with respect to a plan view, at intersections between said scanning electrodes and said display electrodes, and a scanning electrode drive circuit generating a scanning voltage, wherein said display electrode drive circuit which generates a display voltage for each display dot in correspondence to an input digital image signal and which applies the same to a respective display electrode, comprises:

means for dividing said input digital image signal into at least a first bit image signal and a second bit image signal for each display dot;

first display voltage generating means, coupled to the dividing means, for selecting one of plural source voltages which have values that periodically vary independently of said input digital image signal in accordance with said first bit image signal; and second display voltage generating means, coupled to said first display voltage generating means and the dividing means, for sampling an output signal of said first display voltage generating means in accordance with contents of said second bit image signal to thereby provide a display voltage for a respective display electrode.

17. A display electrode drive circuit for use in a display device including scanning electrodes, display electrodes, a display panel on which display dots are formed, with respect to a plan view, at intersections between said scanning electrodes and said display electrodes, and a scanning electrode drive circuit generating a scanning voltage, wherein said display electrode drive circuit which generates a display voltage for each display dot in correspondence to an input digital image signal and which applies the same to a respective display electrode, comprises:

means for dividing said input digital image signal into at least a first bit image signal and a second bit image signal for each display dot;

first display voltage generating means, coupled to receive said first bit image signal and plural source voltages which have values that vary at a predetermined period independently of said input digital image signal, for sampling each of said plural source voltages in accordance with contents of said first bit image signal and provide output signals based on sampling results; and second display voltage generating means coupled to receive said second bit image signal and said output signals of said first display voltage generating means for selecting each of the output signals of said first display voltage generating means in accordance with contents of said second bit image signal to thereby provide a display voltage for a respective display electrode.

18. A display electrode drive circuit according to claim 17, wherein information of a gradation of a picture element formed of the display dot is included in said first bit image signal and/or said second bit image signal.

19. A display electrode drive circuit according to claim 17, wherein at least one source voltage inputted to said first display voltage generating means includes plural gradation voltages for driving a picture element of the display dot.

20. A display electrode drive circuit for use in a display device including scanning electrodes, display electrodes, a display panel on which display dots are formed, with respect to a plan view, at intersections between said scanning electrodes and said display electrodes, and a scanning electrode drive circuit generating a scanning voltage, wherein said display electrode drive circuit which generates a display voltage for each display dot in correspondence to an input digital image signal and which applies the same to a respective display electrode, comprises:

a first data latch circuit latching an input digital image signal in a predetermined timing at least in units of dot;

a second data latch circuit latching simultaneously the digital image signals latched in said first data latch circuit, synchronously with a timing of a line-at-a-time driving operation of the scanning circuit;

means for dividing each of said digital image signals latched in said second data latch circuit into at least a first bit image signal and a second bit image signal in units of display dot;

first display voltage generating means, coupled to receive said first bit image signal and plural source voltages which have values that periodically vary independently of said input digital image signal, for selecting one of said plural source voltages in accordance with said first bit image signal;

second display voltage generating means, coupled to receive plural output signals of said first display voltage generating means and said second bit image signal from the dividing means, for sampling the plural output signals of said first display voltage generating means in accordance with contents of said second bit image signal to thereby provide display voltages for the respective display electrodes; and a line-at-a-time timing circuit outputting output signals from said second display voltage generating means synchronously with a timing of a line-at-a-time driving operation of the scanning circuit.

21. A display electrode drive circuit according to claim 20, wherein said source voltage has a weighted waveform matching with electrooptic characteristics of a liquid crystal.

22. A display electrode drive circuit according to claim 20, wherein said source voltage has a step-like waveform.

23. A display electrode drive circuit according to claim 20, wherein a buffer circuit having an arbitrary voltage amplification is connected to the output side of said line-at-a-time timing circuit.

24. A display electrode drive circuit according to claim 23, wherein said buffer circuit includes capacitors connected to the input side thereof.

25. A display electrode drive circuit according to claim 20, wherein said second display voltage generating means includes capacitors connected to the output side thereof.

26. A display electrode drive circuit for use in a display device including scanning electrodes, display electrodes, a display panel on which display dots are formed, with respect to a plan view, at intersections between said scanning electrodes and said display electrodes, and a scanning electrode drive circuit generating a scanning voltage to thereby display an image on said display panel, wherein said display electrode drive circuit which generates a display voltage for each display dot in correspondence to an input digital image signal and which applies the same to a respective display electrode, comprises:

a first data latch circuit latching an input digital image signal in a predetermined timing at least in units of dot;

a second data latch circuit latching simultaneously digital image signals latched in said first data latch circuit, synchronously with a timing of a line-at-a-time driving operation of the scanning circuit;

means for dividing each of said digital image signals latched in said second data latch circuit into at least a first bit image signal and a second bit image signal in units of display dot;

first display voltage generating means, coupled to receive said first bit image signal and plural source voltages which have values that vary at a predetermined period independently of said input digital image signal, for sampling each of said plural source voltages in accordance with said first bit image signal to provide output signals;

second display voltage generating means, coupled to receive plural output signals of said first display voltage generating means and said second bit image signal from the dividing means, for selecting each of the plural output signals of said first display voltage generating means in accordance with contents of said second bit image signal to thereby provide display voltages for the respective display electrodes; and a line-at-a-time timing circuit outputting output signals from said second display voltage generating means synchronously with a timing of a line-at-a-time driving operation of the scanning circuit.

27. A display electrode drive circuit according to claim 26, wherein said second display voltage generating means includes capacitors connected to the output side thereof.

28. A display electrode drive circuit for use in a display device including scanning electrodes, display electrodes, a display panel on which display dots are formed, with respect to a plan view, at intersections between said scanning electrodes and said display electrodes, and a scanning electrode drive circuit generating a scanning voltage, thereby displaying a color image on said display panel, wherein said display electrode drive circuit which generates a display voltage for each display dot in correspondence to an input digital color image signal and which applies the same to a respective display electrode, comprises:

a first data latch circuit latching an input digital color image signal in a predetermined timing at least in units of dot;

a second data latch circuit latching simultaneously digital color image signals latched in said first data latch circuit, synchronously with a timing of a line-at-a-time driving operation of the scanning circuit;

means for dividing each of said digital color image signals latched in said second data latch circuit into at least a first bit image signal and a second bit image signal in units of display dot;

first display voltage generating means, coupled to receive said first bit image signal and plural source voltages which have values that vary at a predetermined period independently of said input digital color image signal, for sampling each of said plural source voltages in accordance with said first bit image signal to provide output signals;

second display voltage generating means, coupled to receive plural output signals of said first display voltage generating means and said second bit image signal from the dividing means, for selecting each of the plural output signals of said first display voltage generating means in accordance with contents of said second bit image signal to thereby provide display voltages for the respective display electrodes; and a line-at-a-time timing circuit outputting output signals from said second display voltage generating means synchronously with a timing of a line-at-a-time driving operation of the scanning circuit.

29. A display electrode drive circuit according to claim 28, wherein said source voltages are grouped so as to correspond to the color signals and are voltages corresponding to three colors consisting of red, green and blue.

30. A display electrode drive circuit for use in a display device including scanning electrodes, display electrodes, a display panel on which display dots are formed, with respect to a plan view, at intersections between said scanning electrodes and said display electrodes, and a scanning electrode drive circuit generating a scanning voltage, wherein said display electrode drive circuit which generates a display voltage for each display dot in correspondence to digital color image signal and which applies the same to a respective display electrode, comprises:

a first data latch circuit latching an input digital color image signal in a predetermined timing at least in units of dot;

a second data latch circuit latching simultaneously digital color image signals latched in said first data latch circuit, synchronously with a timing of a line-at-a-time driving operation of the scanning circuit;

means for dividing each of said digital image signals latched in said second data latch circuit into at least a first bit image signal and a second bit image signal in units of display dot;

first display voltage generating means, coupled to receive said first bit image signal and plural source voltages of which the values periodically vary independently of said digital color image signals, for selecting one of said plural source voltages in accordance with said first bit image signal;

second display voltage generating means, coupled to receive plural output signals of said first display voltage generating means and said second bit image signal from the dividing means, for sampling the plural output signals of said first display voltage generating means in accordance with contents of said second bit image signal to thereby provide display voltages for the respective display electrodes; and a line-at-a-time timing circuit outputting output signals from said second display voltage generating means synchronously with a timing of a line-at-a-time driving operation of the scanning circuit.

* * * * *